US012515844B2

(12) United States Patent
Keast

(10) Patent No.: US 12,515,844 B2
(45) Date of Patent: Jan. 6, 2026

(54) CORE TRAY

(71) Applicant: Prospectors IP Holdings Pty Ltd, Bella Vista (AU)

(72) Inventor: Robert Keast, Bella Vista (AU)

(73) Assignee: Prospectors IP Holdings Pty Ltd, Bella Vista (AU)

( * ) Notice: Subject to any disclaimer, the term of this patent is extended or adjusted under 35 U.S.C. 154(b) by 77 days.

(21) Appl. No.: 18/717,880

(22) PCT Filed: Dec. 14, 2022

(86) PCT No.: PCT/AU2022/051500
§ 371 (c)(1),
(2) Date: Jun. 7, 2024

(87) PCT Pub. No.: WO2023/108209
PCT Pub. Date: Jun. 22, 2023

(65) Prior Publication Data

US 2025/0042598 A1 Feb. 6, 2025

(30) Foreign Application Priority Data

Dec. 14, 2021 (AU) ..... 2021904047
Oct. 14, 2022 (AU) ..... 2022903015

(51) Int. Cl.
*B65D 1/36* (2006.01)
*B65D 25/06* (2006.01)
(Continued)

(52) U.S. Cl.
CPC ..... *B65D 1/36* (2013.01); *B65D 25/06* (2013.01); *B65D 25/205* (2013.01); *B65D 25/30* (2013.01); *E21B 25/005* (2013.01)

(58) Field of Classification Search
CPC ..... B65D 1/36; B65D 25/06; E21B 25/005
See application file for complete search history.

(56) References Cited

U.S. PATENT DOCUMENTS

2016/0059987 A1 3/2016 Keast

FOREIGN PATENT DOCUMENTS

AU 2019257540 B1 8/2020
AU 2020217372 A1 5/2021
(Continued)

OTHER PUBLICATIONS

International Search Report issued in Application No. PCT/AU2022/051500, mailed Feb. 14, 2023.
(Continued)

*Primary Examiner* — Mollie Impink
(74) *Attorney, Agent, or Firm* — Amster, Rothstein & Ebenstein LLP

(57) ABSTRACT

A tray for storing geological drill core samples, comprising a plurality of slots, each slot, when viewed in cross-section, comprise a laterally extending slot base (24), a pair of side walls (26), and a support portion (28) extending from a lower end of each side wall to a proximal lateral side of the base, and the support portions receive and support the at least one drill core sample above the slot base and inhibit said drill core sample from contacting said slot base. The support portions may be convexly curved and may have a channel recessed (30) thereinto. The tray may further comprise ribbing between a pair of adjacent slots of the plurality of slots; a slot divider; peripheral upper surface portions comprising a reference marker; a substantially planar surface or panel to enable a user to write on or affix a label; ruler is formed upon an upper surface.

22 Claims, 11 Drawing Sheets

(51) Int. Cl.

| | |
|---|---|
| ***B65D 25/20*** | (2006.01) |
| ***B65D 25/30*** | (2006.01) |
| ***E21B 25/00*** | (2006.01) |

(56) References Cited

FOREIGN PATENT DOCUMENTS

| | | | |
|---|---|---|---|
| CN | 202529335 | U | 11/2012 |
| SU | 1685812 | A1 | 10/1991 |
| WO | 2014170826 | A2 | 10/2014 |

OTHER PUBLICATIONS

Written Opinion issued in Application No. PCT/AU2022/051500, mailed Feb. 14, 2023.

CORE TRAY

CROSS-REFERENCE TO RELATED APPLICATIONS

The present application is a U.S. national stage entry under 35 U.S.C. § 371 of PCT International Patent Application No. PCT/AU2022/051500, filed 14 Dec. 2022, which claims priority from AU 2021904047, filed in Australia on 14 Dec. 2021, and AU 2022903015, filed in Australia on 14 Oct. 2022 entirety of each of which are incorporated herein by reference.

TECHNICAL FIELD

The present invention relates generally to the field of geological drill core trays.

BACKGROUND

A core sample is a material sample that is typically cylindrical in shape. Most core samples are obtained by drilling into the material with a drill formed from a hollow steel tube (commonly referred to as a core drill). Generally, the material is a naturally-occurring soil or rock, although core samples are often taken from man-made materials, such as concrete, ceramics, or metal.

The drilling and collection of core samples is quite common in the mining industry, where geologists undertake exploratory drilling in search for the presence (or in some cases the absence) of certain mineral or metal content, or mineral assemblies which are associated with certain mineral or metal content.

When core samples are taken, there is a need to house, organise, transport, catalogue and store the samples. It is known to use "core trays" (sometimes referred to as "core boxes") to house, organise, transport, catalogue and store the samples. Core trays are, as the name implies, tray-like devices with a number of elongate slots or channels, each channel being arranged to hold a length of a core sample.

Generally, such trays are constructed from a wooden, metal or plastic material. The choice of material, in the past, has largely been determined by local resources and skills. For example, in Canada, core trays are commonly made from wood, as wood is generally in abundant supply near the areas where mineral or mining exploration occurs.

There is generally no set standard for core trays, other than the general requirement to size the channels such that core samples can fit into the channels. The length and width of the trays are generally a function of local requirements. It is quite common for different companies and/or mine sites to have different tray size requirements.

Core samples can also roll from side to side in traditional core trays, which can mean that any markings made to the core for example by a geologist can lose their upward alignment. fragile drill cores, in particular, are prone to breaking apart as they roll side to side, which can particularly occur during transport. Heavily jointed core samples can also lose their relative (reassembled) alignment during transport, which can be problematic if the samples need to be re-analysed.

Traditional core trays also tend to be quite heavy. Core trays made from plastic are known, however the quantities of plastic required to support heavy materials such as rock tend to be significant. There is scope to improve upon plastic core trays of the prior art through innovative ribbing arrangements.

An example prior art rock core tray is disclosed in SU 1685812 A1, of which FIG. 5 is reproduced as Prior Art FIG. 1 herein. As illustrated, the prior art tray is provided with slots having a first curvature defined by a first radius D, and a lower second curvature defined by a second radius $\alpha$. Resulting from the differences in radii, the two curvatures meet at a ridge, which can represent a focal point for stresses applied to a drill core. The ridge can penetrate a drill core that is at least partially comprised of softer rock, which may induce or propagate fractures. Such a ridge may also act as a tooth which grips the rock core, rendering handling more difficult, and also more generally limits the range of rock cores that can be suitably rested thereupon.

Prior art core trays are also not suitably configured for photographic analysis. Such analytical techniques rely upon the presence of orienting markers and a semblance of uniformity in the core tray.

A wide-angled lens is typically used for industrial purposes, as a complete image of a subject can be captured without requiring the camera be positioned far away therefrom. Wide-angled lenses induce substantial distortion in the resulting photographic image—which is less than ideal—but many cameras and image-processing programs can address this by analysing the distorted image and applying a "distortion profile" to correct the distortion and reconstruct the 'undistorted appearance' of the photographed subject. However, distortion profiles are most often designed to ensure that the central region of a photographic image is corrected most accurately (since whatever is to be analysed is typically the focal point of the photographic image and thus will be at or close to the centre thereof), and as a result the distortion profile is often inaccurate towards the edges of an image, and can be severely inaccurate in the corners thereof. As a result, the position, arrangement, size (and even colour, depending upon the nature of the distortion) of elements of the photography subject that are in the corners of the photograph may be inaccurately reconstructed.

Prior art core trays are often adapted with markers at the corners thereof, as these are the most intuitive locations for providing a means of quickly establishing position, orientation, length and width. However, due to the aforementioned distortion and the inaccuracy of the corrective measures, the accuracy of the prior art core tray markers may be negatively affected, with the degree of inaccuracy in the prior art reference markers in a photograph depending upon how centred the tray is therewithin. Additionally, the corrective distortion profile may accurately reconstruct the 'undistorted appearance' of the core samples as they are more central within the image, but due to the aforementioned issues, the position, size and arrangement of reference markers in the corner may be inaccurately reconstructed, negatively affecting the accuracy of any subsequent analyses of the contents of the image.

The present invention aims to address one or more of the deficiencies noted in the prior art.

DISCLOSURE OF THE INVENTION

In a first aspect, the present invention relates to a tray for storing geological drill core samples, comprising an upper side and a lower side, and a plurality of slots formed into the upper side, each of the slots having an internal space extending along a longitudinal axis of the respective slot, the internal space adapted to receive at least one of the drill core samples therewithin, wherein a cross-section of each of the plurality of slots is substantially constant for at least partway along the longitudinal axis of the respective slot, each of the plurality of slots, when viewed in the substantially-constant cross-section, comprise a laterally-extending slot base, a pair of side walls, one being positioned on either lateral side of the base, and a support portion extending from a lower end of each side wall to a proximal lateral side of the base, and the support portions are adapted to receive and support the at least one drill core sample thereupon above the slot base and to inhibit said drill core sample from contacting said slot base.

In an embodiment the support portions, when viewed in the substantially-constant cross-section, are convexly curved for at least a portion thereof, relative to the internal space of their respective slot.

In an embodiment the support portions have a channel recessed thereinto for at least a portion of their length.

In an embodiment, when viewed in the substantially-constant cross-section, each channel is substantially arcuate in shape, said arc having a constant support channel radius projected from a radial centre, and the channels of a particular slot of the plurality of slots have support channel radii of identical length and a common radial centre within the internal space of the particular slot.

In an embodiment the particular slot of the plurality of slots is adapted to receive an optimally-sized drill core sample, being a drill core sample having a substantially-circular cross section with an associated core sample radius that is substantially identical to the support channel radii of the channels of the particular slot.

In an embodiment, when viewed in the substantially-constant cross-section, the base is concavely curved for at least a portion thereof relative to the internal space of the respective slot.

In an embodiment, when viewed in the substantially-constant cross-section, the pair of side walls are angled away from one another such that the lower ends of each of the pair of side walls are closer together than an upper end of each of the pair of side walls.

In an embodiment the tray further comprises a ribbing arrangement between a pair of adjacent slots of the plurality of slot, wherein the ribbing arrangement comprises a longitudinally-extending rib arranged to extend parallel to adjacent side walls of the adjacent pair of slots, a first sequence of ribbing extending at least partially laterally from the longitudinally-extending rib and to a lower side of one of the pair of adjacent slots, and a second sequence of ribbing extending at least partially laterally from the longitudinally-extending rib and to a lower side of the other one of the pair of adjacent slots.

In an embodiment a particular slot in the plurality of slots has an adjacent slot on one side thereof and a further adjacent slot on an opposing side thereof, the particular slot and the adjacent slot are the pair of adjacent slots with the ribbing arrangement therebetween, and the particular slot and the further adjacent slot are a further pair of adjacent slots with a further ribbing arrangement therebetween.

In an embodiment at least one of the first and second sequences of ribbing comprise a plurality of first ribs that extend substantially perpendicularly to the longitudinally-extending rib, and a plurality of second ribs that extend obliquely to the longitudinally-extending rib and substantially parallel to one another, each one of the first and second ribs having proximal and distal ends, the proximal ends being proximal to the longitudinally-extending rib and the distal ends being proximal to the lower surface of the slot, and the at least one sequence is formed by alternating first and second ribs.

In an embodiment the formed sequence is a sawtooth sequence, the proximal end of each first rib in the formed sequence meets the proximal end of the preceding second rib in the formed sequence, and the distal end of each first rib meets the distal end of the succeeding second rib in the formed sequence.

In an embodiment both the first and second sequences comprise the sequence formed by alternating first and second ribs, and the second sequence is longitudinally staggered with respect to the first sequence, such that the plurality of first ribs of the second sequence do not align with the plurality of first ribs of the first sequence.

In an embodiment the plurality of second ribs of the first sequence are substantially non-parallel to the plurality of second ribs of the second sequence.

In an embodiment wherein adjacent side walls of the pair of adjacent slots are joined to one another at an upper end thereof by an upper connective portion, the longitudinally-extending rib extends downwardly from a lower surface thereof.

In an alternative embodiment the tray further comprises a ribbing arrangement extending, for at least a portion of a length of the tray, between a pair of adjacent slots of the plurality of slots, wherein said ribbing arrangement comprises a first sequence of ribbing comprising perpendicular ribs that alternately extend from a lower surface of a first one of the pair of adjacent slots and towards a second one thereof, and from a lower surface of the second one of the pair of adjacent slots and towards the first one thereof, and a second sequence of ribbing comprising obliquely-oriented ribs extending between ends of each sequential pair of perpendicular ribs of the first sequence.

In an embodiment at least one of the plurality of slots comprises a first adjacent slot on one side and a second adjacent slot on its opposing side, a first ribbing arrangement extends between the at least one slot and the first adjacent slot, with a portion of the first ribbing sequence thereof extending from a lower surface of the at least one slot towards the first adjacent slot, a second ribbing arrangement extends between the at least one slot and the second adjacent slot, with a portion of the first ribbing sequence thereof extending from the lower surface of the at least one slot towards the first adjacent slot, and the ribs of the portion of the first ribbing sequence of the first ribbing arrangement are substantially aligned with the ribs of the portion of the first ribbing sequence of the second ribbing arrangement.

In an embodiment an angle between each of the perpendicular ribs and their respective obliquely-oriented ribs is between 100° and 150°, inclusive. In an embodiment the angle is between 110° and 135°, inclusive. In an embodiment the angle is approximately 120°.

In an embodiment wherein the tray comprises an embodiment of a ribbing arrangement and the slot base comprises a lower base surface, at least a portion of which forms a resting surface of the tray, at least one lower edge of the ribbing arrangement is substantially flush with the resting surface, and no portion of the ribbing arrangement protrudes past the resting surface.

In an embodiment the tray further comprises outer walls that extend substantially around the periphery, and the outer walls comprise handles that are spaced outwardly from the slots so as to provide a clearance for a user' fingers.

In an embodiment the slot base comprises a lower base surface, at least a portion of which forms a resting surface of the tray, at least a portion of a lower edge of the outer walls is substantially flush with the resting surface, and no portion of the lower edge of the outer walls extends below the resting surface.

In an embodiment the tray further comprises a slot divider that is affixable at a position along the longitudinal axis of a particular slot of the plurality of slots, wherein the slot divider is shaped to be substantially complementary to the substantially-constant cross-section of the particular slot, and the slot divider further comprises, on an upper end thereof, a substantially planar surface or panel adapted to enable a user of the tray to write thereupon or affix a label thereto.

In an embodiment wherein the tray has a tray length parallel to the longitudinal axes of each of the plurality of slots and a tray width perpendicular thereto, the tray further comprises a peripheral upper surface that encircles the plurality of slots, the peripheral upper surface being divisible into four peripheral upper surface portions consisting of a pair of longitudinally-extending portions and a pair of laterally-extending portions, each of the peripheral upper surface portions comprise a reference marker positioned thereupon, and for each of the peripheral upper surface portions, the reference marker is positioned at a distance from a centre of the respective peripheral upper surface portion less than or equal to a distance from an end thereof.

In an embodiment, for each of the peripheral upper surface portions, a distance from the reference marker to the centre of the respective peripheral upper surface portion is one half or less than a distance from the reference marker to the end thereof.

In an embodiment, for each of the peripheral upper surface portions, a distance from the reference marker to the centre of the respective peripheral upper surface portion is one quarter or less than a distance from the reference marker to the end thereof.

In an embodiment, for each of the peripheral upper surface portions, the reference marker is positioned at, or substantially proximal to, the centre of the respective peripheral upper surface portion.

In an embodiment, each of the peripheral upper surface portions further comprise a further reference marker positioned at a distance from a centre of the respective peripheral upper surface portion less than or equal to a distance from an end thereof.

In an embodiment the tray further comprises a substantially planar surface or panel adapted to enable a user of the tray to write thereupon or affix a label thereto.

In an embodiment adjacent side walls of adjacent slots are joined to one another at an upper end thereof by an upper connective portion, and a ruler is formed upon an upper surface thereof and arranged to enable a user to measure a length of a drill core sample within one of the plurality of slots.

Further embodiments may be disclosed herein or may become obvious based upon the disclosure contained herein. These and other embodiments are also considered to fall within the scope of the invention.

DESCRIPTION OF FIGURES

Embodiments of the present invention will now be described in relation to figures, wherein.

DETAILED DESCRIPTION OF PREFERRED EMBODIMENTS

Figure 1:
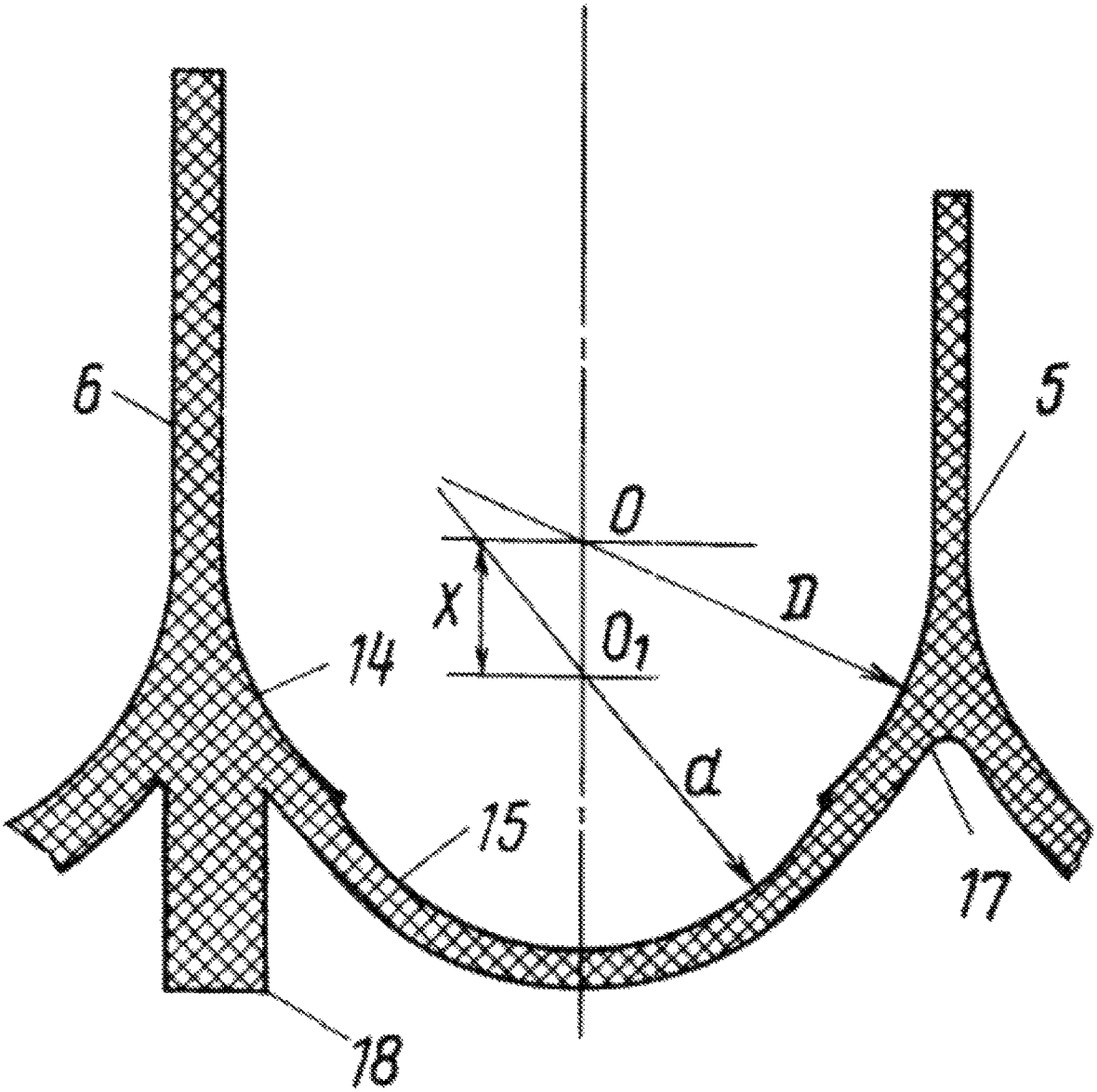
FIGURE 1 (PRIOR ART)
FIG. 1 depicts a cross-section of a prior art core tray.

In a first aspect, the present invention relates to a tray for storing geological drill core samples having a plurality of substantially-parallel slots arranged to receive and support the core samples therewithin. In an embodiment and with reference to FIG. 2, the tray 10 may comprise an upper side 12 and a lower side 14, and a plurality of slots 16 formed into the upper side. Each of the slots 16 may have an internal space 18 extending along a longitudinal axis 20 of the respective slot which is adapted to receive at least one of the drill core samples (not depicted) therewithin.

For ease of explanation, the present specification will describe various embodiments of the tray 10 of the present invention through reference to the properties of a cross-section of either the tray 10 or a particular slot 16 of the tray. The person skilled in the art will appreciate that any embodiment of a tray 10 of the present invention so described will have a constant cross-section for a substantial portion of the length thereof. The person skilled in the art will further appreciate that the terminology"

Figure 2:
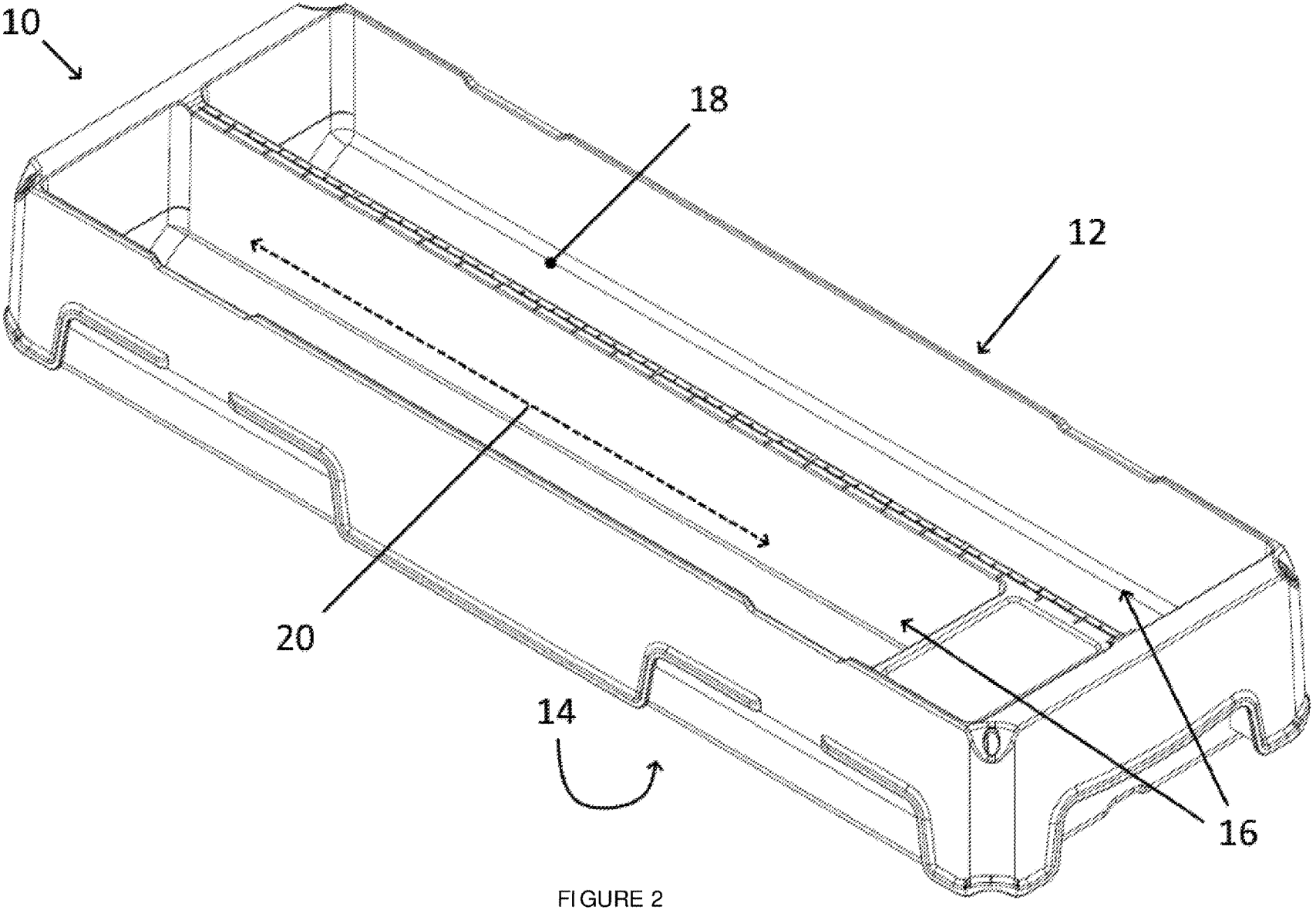
FIG. 2 depicts an embodiment of a core tray of the present invention.
Figure 3:
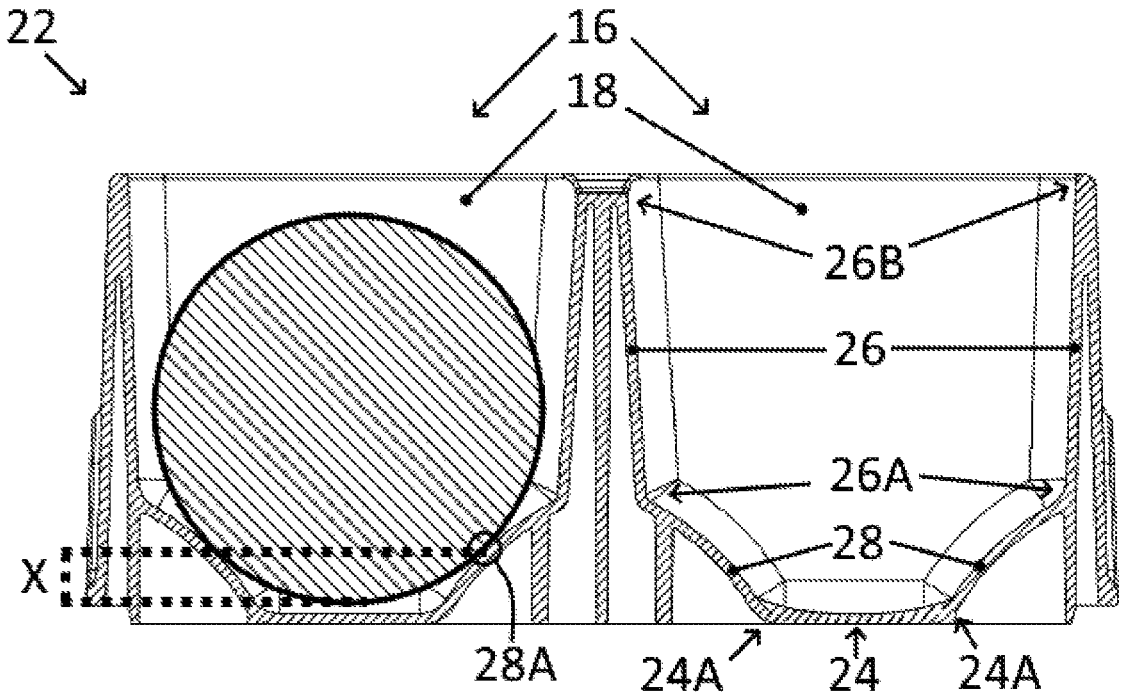
FIGS. 3 & 4 depict cross-sections of embodiments of the core tray.

In an embodiment, and with reference to FIGS. 2 & 3, the plurality of slots 16 may have a cross-section 22 that is substantially constant for at least partway along the longitudinal axis 20 of the respective slot. In such an embodiment, the substantially-constant slot cross-section 22 may comprise a laterally-extending slot base 24, a pair of side walls 26, one being positioned on either lateral side of the base, and a support portion 28 extending from a lower end 26A of each side wall to a proximal lateral side 24A of the base. The support portions 28 are adapted to receive and support the at least one drill core sample thereupon above the slot base 24 and to inhibit said drill core sample from contacting said slot base. Because drill core samples are taken from a variety of ground types, some may contain water or other liquids which will naturally exit the sample. If this liquid is allowed to remain in contact with the drill core sample, it may damage the sample such as by eroding or dissolving parts thereof. By keeping the drill core elevated, the space between the drill core sample and the slot base 24 provides a drainage channel.

Without limiting the scope of the invention through theory, it is considered that placing the support portions 28 in the outer regions of the slot 16 (when viewed in cross-section 22) may improve the stability of a drill core sample received and held therewithin. A primary source of damage to a drill core sample is lateral movement (i.e. rolling from side to side). Prior art core trays, such as the prior art tray shown in FIG. 1, provide surfaces for a stored core sample to roll. In contrast, and with reference to the left-hand side of FIG. 3, a core sample received and held between the two support portions 28 will be held such that a portion of its mass (denoted by X) is below the "points of support" 28A, i.e. where the support portions 28 contact the core sample. This means that substantially greater force is required to induce rolling in the stored core sample, and a portion of said force must be upwardly directed so that the lowermost portion of the core sample can roll up and over the point of support 28A of the support portion 28.

In an embodiment and with reference to FIG. 3, the support portions 28, when viewed in the substantially-constant slot cross-section 22, may be convexly curved for at least a portion thereof. Said convex curvature may be relative to the internal space 18 of the respective slot 16. Without limiting the scope of the invention by theory, convexly-sloped support portions 28 may be able to support drill core samples of various diameters. The greater the drill core sample's diameter, the higher it will naturally sit when rested upon the support portions 28 within the slot 16, thereby maintaining the drill core sample above the slot base 24. This may provide a core tray 10 that is more adaptable, as opposed to prior art core trays with support ribbing optimised for drill core samples of a specific diameter. It is further considered that the convex curvature of the support portions 28 may enhance the 'lateral restraining' ability of said support portions. This effect is considered to likely be more pronounced on smaller-sized core samples which will sit lower on the curved support portions 28—the point of support would be lower on the curved support portion 28 and thus present a slope to the core sample resting thereagainst that is 'more vertical' than a point higher up the support portion's convexly-curved surface. This would potentially require additional force to be induced in the core sample to overcome inertia and begin rolling. Such an embodiment is considered to be of particular importance for embodiments of the tray 10 that are likely to be used to hold core samples of a variety of core sample radii, as the slot 16 will be wide enough to accept core samples of larger radii and therefore, without the convexly-curved support portions 28, would potentially provide more lateral space for a core sample of smaller radius to roll around and become damaged.

In an embodiment and as depicted by the right-hand side of FIG. 3, the slot base 24, when viewed in the substantially-constant slot cross-section 22, may be concavely curved for at least a portion thereof relative to the internal space of the respective slot. This may provide additional clearance between the drill core sample and the slot base 24, thereby improving drainage ability.

Figure 4:
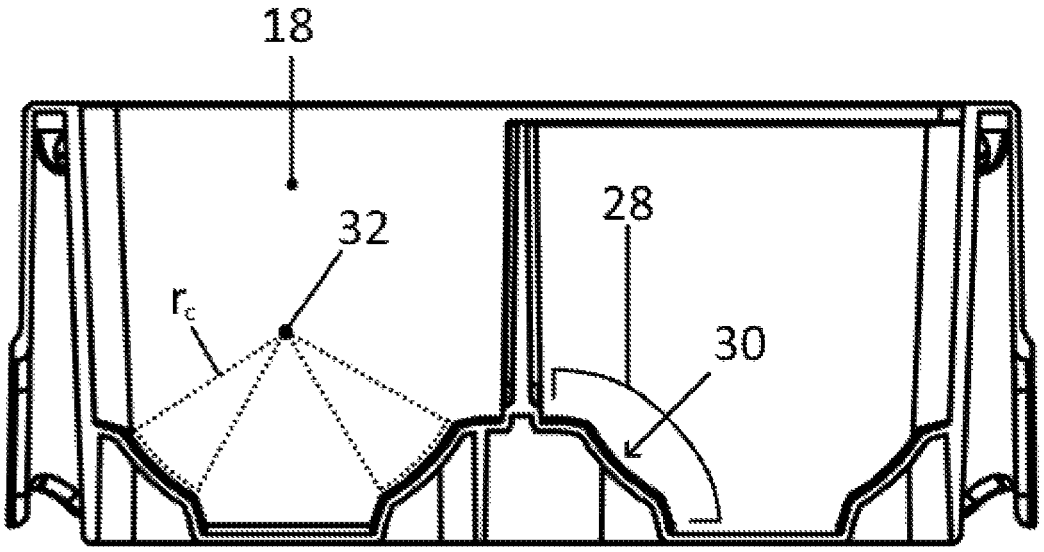

In an embodiment and with reference to FIG. 4, the support portions 28 may have a channel 30 recessed thereinto for at least a portion of their length. In a further embodiment and when viewed in the substantially-constant slot cross-section 22, each channel 30 may be substantially arcuate in shape. The arc of each channel 30 may have a constant support channel radius $r_c$, (depicted in FIG. 4 as dotted lines) projected from a radial centre 32. In a further embodiment, each channel 30 of a particular slot may have support channel radii of identical length and a common radial centre 32 that is positioned within the internal space 18 of the particular slot. In such an embodiment, the drill core sample may rest within and be supported by the channels 30. In a further embodiment, the particular slot of may be adapted to receive an optimally-sized drill core sample having a substantially-circular cross section and an associated core sample radius that is substantially identical to the support channel radii $r_c$ of the channels of the particular slot.

Figure 5A:
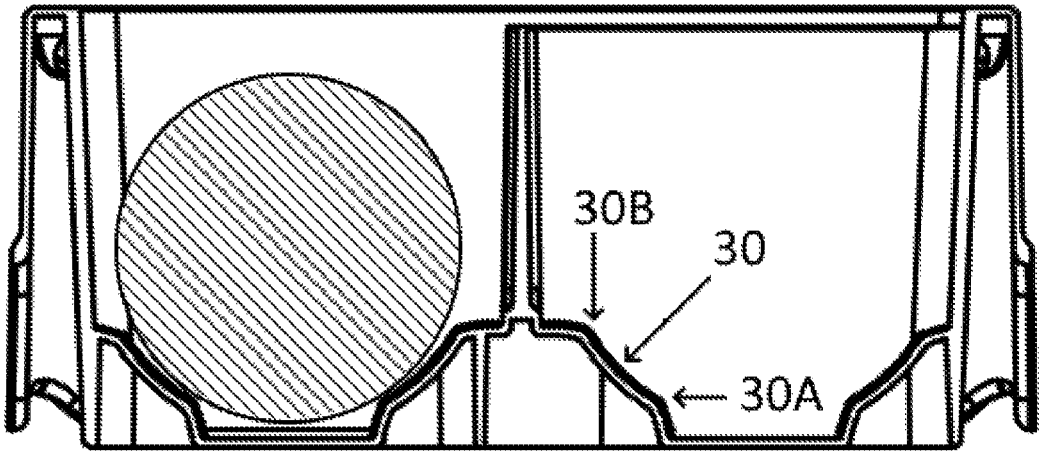
FIGS. 5A-5C depict the embodiment of the core tray shown in FIG. 4 with different-sized core samples placed therein.
Figure 5B:
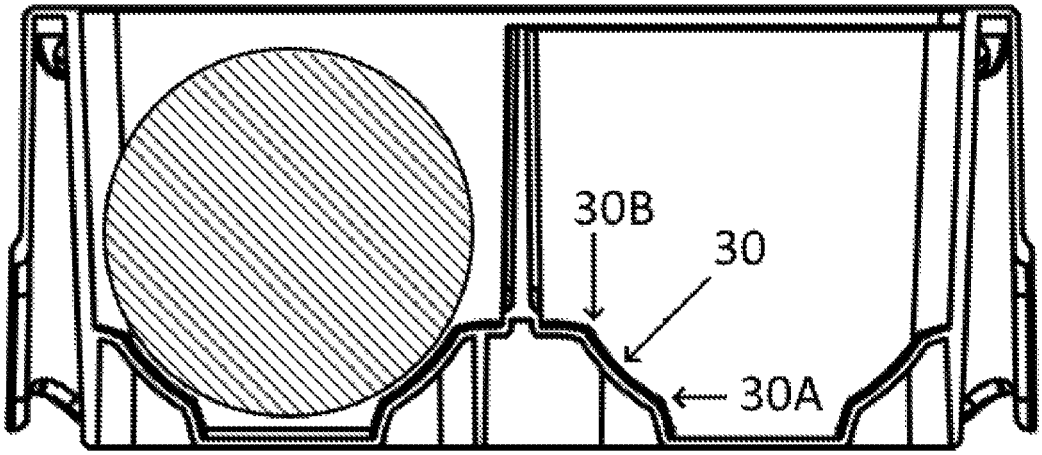
Figure 5C:
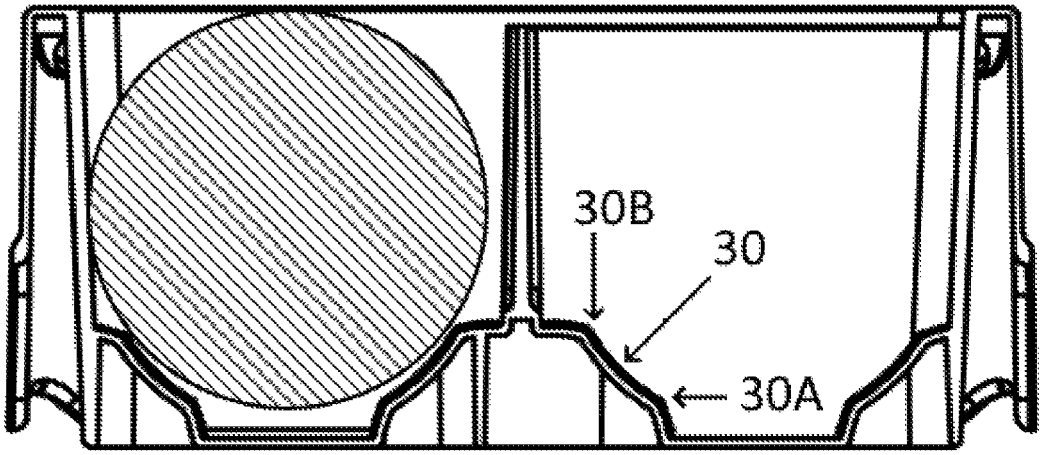

Without limiting the scope of the invention through theory, it is considered that the concave nature of the channel 30 may reduce the overall ability of the support portions 28 to support drill core samples of a range of core sample radii, but will not negate the aforementioned ability. Rather, the flexibility provided by the support portions is not lost entirely—core samples having a core sample radius slightly smaller or slightly larger than the support channel radius are still able to rest within the resulting 'cradle' while maintaining clearance above the slot base 24. This is depicted in FIGS. 5A-C, which show, in sequence, an example core sample that is smaller than, equal to, or larger than an "optimally-sized" core sample. Such an embodiment may be of use in situations wherein the tray 10 may expect to receive core samples having a range of radii, but one particular core sample radius will be the most common, which would thus be defined as the radius of an optimally-sized core sample.

The person skilled in the art may anticipate that using channels 30 to form a partial concave 'cradle' may enable a drill core sample to roll from side to side, much as in the prior art. However, as there is still no support in the central region of the slot base 24, the ability of a drill core sample to roll remains substantially inhibited. In effect, a drill core sample that is slightly too small compared to the optimally-sized drill core sample will be laterally restrained between the lowermost edges 30A of the channels, and in order to 'roll' the core sample would first need to move upwards and over the lowermost edge. This may be contrast against the 'cradle shape' exhibited in prior art FIG. 1, wherein a core sample smaller than an optimally-sized one would be able to laterally roll with greater ease, as there is more 'surface' directly beneath the core sample to roll upon. A similar principle would apply to a drill core sample that is slightly larger than the optimally-sized drill core sample, except that it would instead be laterally restrained between the uppermost edges of the channels 30B.

In an embodiment and with return reference to FIG. 2, the pair of side walls 26 of a particular slot, when viewed in the substantially-constant slot cross-section 22, may be angled away from one another such that the lower ends 26A of each of the pair of side walls are closer together than an upper end 26B of each of the pair of side walls. This may reduce the difficulty of placing and/or removing a drill core sample from the slot 16.

Figure 6:
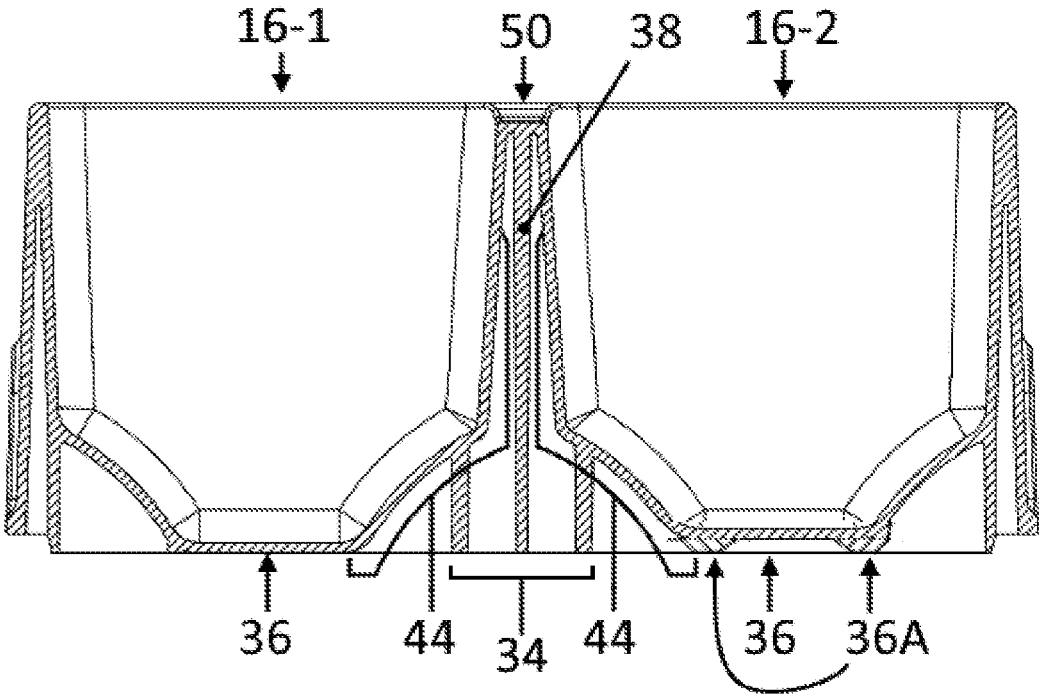
FIG. 6 depicts a cross-section of an embodiment of the core tray comprising structural ribbing arrangements.

In an embodiment and with reference to FIG. 6, the tray 10 may further comprise a ribbing arrangement 34 between a pair of adjacent slots 16-1, 16-2 of the plurality of slots. The ribbing arrangement may extend at least partway along a length of the tray. In a further embodiment wherein the slot base 24 comprises a lower base surface 36 and at least a portion thereof is adapted to provide a resting surface 36A, the ribbing arrangement 34 may be configured such that at least one lower edge is substantially flush with the resting surface, and no portion of the ribbing arrangement protrudes past the resting surface.

Figure 7:
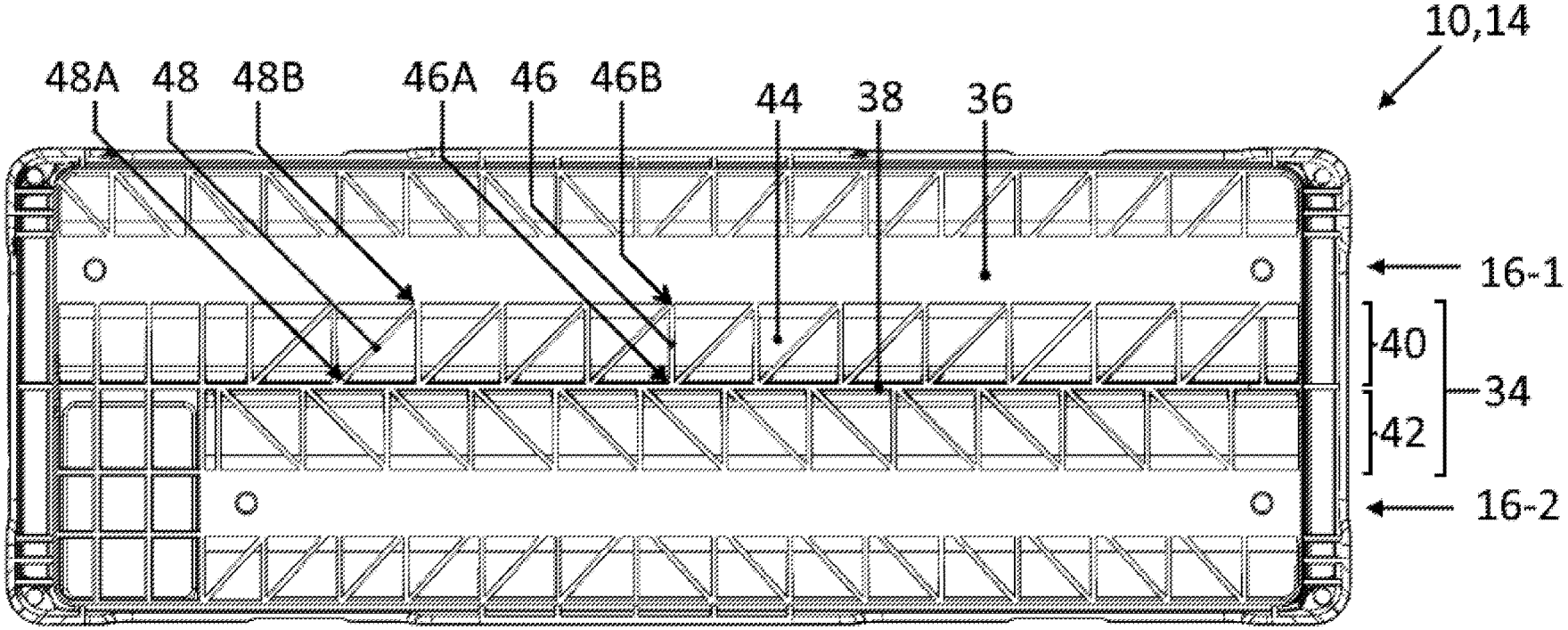
FIGS. 7 & 8 depict an embodiment of the core tray having a first structural ribbing arrangement.
Figure 8:
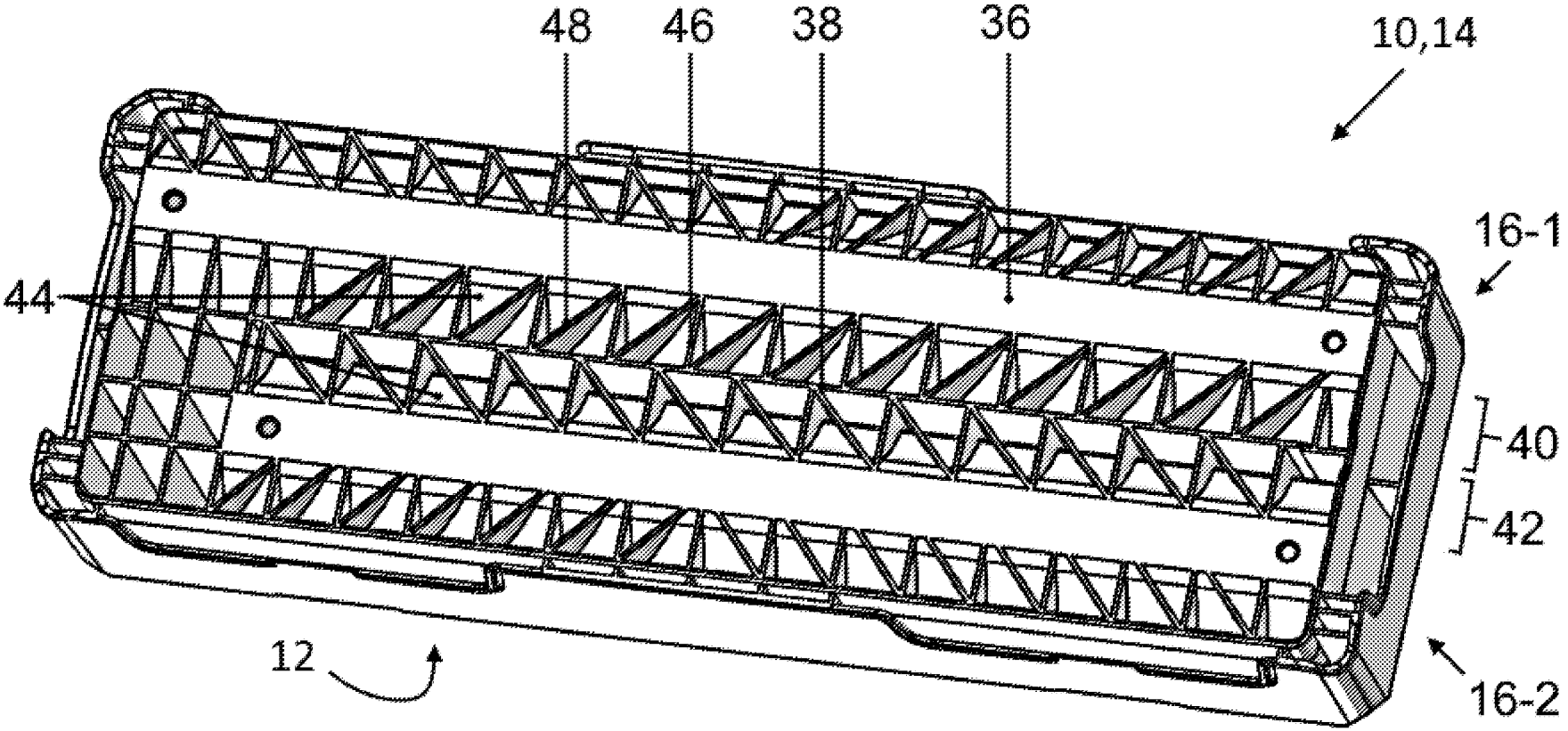

In a further embodiment and with reference to FIGS. 7 & 8, the ribbing arrangement 34 may comprise a longitudinally-extending rib 38 arranged to extend parallel to adjacent side walls 26-1, 26-2 of the adjacent pair of slots 16-1, 16-2, and a first and second sequence of ribbing 40, 42. Each sequence of ribbing 40, 42 may be on opposing sides of the longitudinally-extending rib 38 and extend at least partially laterally therefrom to a lower side surface 44 of a proximal one of the pair of adjacent slots. As depicted, the first sequence of ribbing 40 extends to a lower side 14 of one of the pair of adjacent slots 16-1, while the second sequence of ribbing extends to a lower side 14 of the other one of the pair of adjacent slots 16-2.

In an embodiment wherein a particular slot has an adjacent slot on one side thereof and a further adjacent slot on an opposing side thereof, the particular slot and the adjacent slot may be a pair of adjacent slots with the ribbing arrangement therebetween, and the particular slot and the further adjacent slot may be a further pair of adjacent slots with a further ribbing arrangement therebetween. The skilled person will appreciate that in the present embodiment, the 'particular slot' may encompass any slot within a plurality of slots provided that said slot has adjacent slots on each lateral side, and a tray 10 may comprise more than one particular slot.

In an embodiment and with reference to FIG. 7 or 8, at least one of the first and second sequences of ribbing 40, 42 may comprise a plurality of first ribs 46 that extend substantially perpendicularly to the longitudinally-extending rib 38, and a plurality of second ribs 48 that extend obliquely to the longitudinally-extending rib 38, the second ribs being substantially parallel to one another. The first ribs 46 of a specific sequence may be of substantially similar length to one another and spaced substantially equidistant apart. The second ribs 48 of a specific sequence may also be of substantially similar length to one another. In a further embodiment, each one of the first and second ribs 46, 48 may have proximal ends (46A, 48A) and distal ends (46B, 48B). The nomenclature of the ends is to be interpreted as follows: the proximal ends (46A, 48A) are proximal to the longitudinally-extending rib 38, and the distal ends (46B, 48B) are proximal to the lower side surface 44 of the slot 16. In a further embodiment, the first sequence 40 and/or the second sequence 42 is formed by alternating first and second ribs 46, 48.

In a further embodiment, the formed sequence may be a 'sawtooth' sequence, having the approximate appearance of the teeth of a sawblade. In such an embodiment, the proximal end 46A of each first rib 46 meets the proximal end 48A of the preceding second rib 48 in the formed sequence, and the distal end 46B of each first rib 46 meets the distal end 48B of the succeeding second rib 48 in the sequence. Similarly, the proximal end 48A of each second rib 48 meets the proximal end 46A of the succeeding first rib 46 in the formed sequence, and the distal end 48B of each second rib 48 meets the distal end 46B of the preceding first rib 46 in the sequence. The skilled person will appreciate that the direction of the sequence as described above is arbitrary.

The sawtooth configuration is considered particularly beneficial as a ribbing arrangement, as each 'step' in the sequence is triangularly shaped. As a result, the ribbing arrangement effectively forms a truss-type structure between adjacent slots. The skilled person will appreciate that triangle-based truss structures are exceptionally strong and rigid, and provide an efficient means of strengthening the tray 10 without using excess material in construction.

In an embodiment, both the first and second sequences 40, 42 may be comprised of alternating first and second ribs 46, 48. In a further embodiment, the second sequence 42 may be longitudinally staggered with respect to the first sequence 40, such that the plurality of first ribs 46 of the second sequence 42 do not substantially align with the plurality of first ribs 46 of the first sequence 40.

In an embodiment, the second ribs 48 of the first sequence 40 may be substantially non-parallel to the second ribs 48 of the second sequence 42. In a further embodiment, an angle between any one of the second ribs 48 of the first sequence 40 and the longitudinally-extending rib 38 may be substantially similar to an angle between any one of the second ribs 48 of the second sequence 42 and the longitudinally-extending rib 38, but in an opposite direction therefrom.

In an embodiment and with return reference to FIG. 6, adjacent side walls 26-1, 26-2 of the adjacent pair of slots 16-1, 16-2 may be joined to one another at an upper end 26B-1, 26B-2 thereof by an upper connective portion 50. In such an embodiment, the longitudinally-extending rib 38 may extend downwardly from a lower surface thereof.

Figure 9:
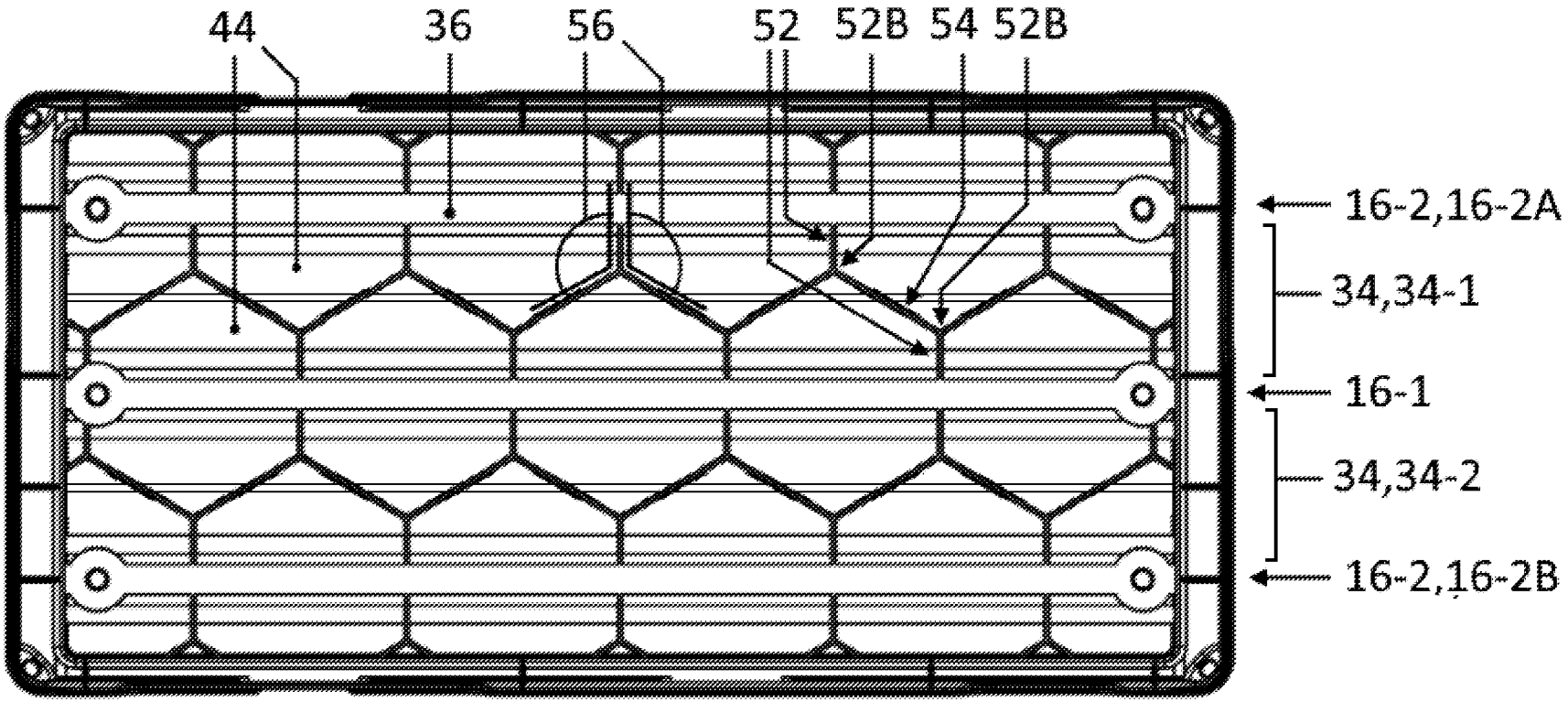
FIG. 9 depicts an embodiment of the core tray having a second structural ribbing arrangement.

In an alternate embodiment and with reference to FIG. 9, the ribbing arrangement 34 that extends between a pair of adjacent slots 16-1, 16-2, for at least a portion of a length of the tray 10 may have a first sequence of ribbing comprising perpendicular ribs 52 that alternately extend, in a perpendicular direction, from a lower side surface 44 of the first slot 16-1 of the pair and towards the second slot 16-2, and from a lower side surface 44 of the second slot 16-2 towards the first slot 16-1. The ribbing arrangement may further have a second sequence of ribbing that comprises obliquely-oriented ribs 54 extending between ends 52B of each sequential pair of perpendicular ribs 52 of the first sequence. The arrangement of obliquely-oriented ribs 54 of the second sequence may form a zig-zag pattern.

In a further embodiment wherein at least one particular slot 16-1 has a first adjacent slot 16-2A on one side and a second adjacent slot 16-2B on its opposing side, the tray 10 may comprise a first ribbing arrangement 34-1 between the particular slot 16-1 and the first adjacent slot 16-2A, and a second ribbing arrangement 34-1 between the particular slot 16-1 and the second adjacent slot 16-2B. In such an embodiment, a portion of the first ribbing sequence of the first ribbing arrangement 34-1 will extend from a lower side surface 44 of the particular slot 16-1 towards the lower side surface 44 of the first adjacent slot 16-2A, and similarly, a portion of the first ribbing sequence of the second ribbing arrangement 34-2 will extend from a lower side surface 44 of the particular slot 16-1 towards the lower side surface 44 of the second adjacent slot 16-2B. In a further embodiment, the first ribbing sequences that outwardly extend in either direction from the lower side surface 44 of the particular slot 16-1 may be substantially aligned with one another, such that there is substantially no staggering between the first ribbing arrangement 34-1 and the second ribbing arrangement 34-2.

In an embodiment, an angle 56 between each of the perpendicular ribs 52 and their respective obliquely-oriented ribs 54 is between 100° and 150°, inclusive. In a further embodiment, the angle 56 may be between 110° and 135°, inclusive. In a further embodiment, the angle 56 may approximately be 120°.

Figure 10:
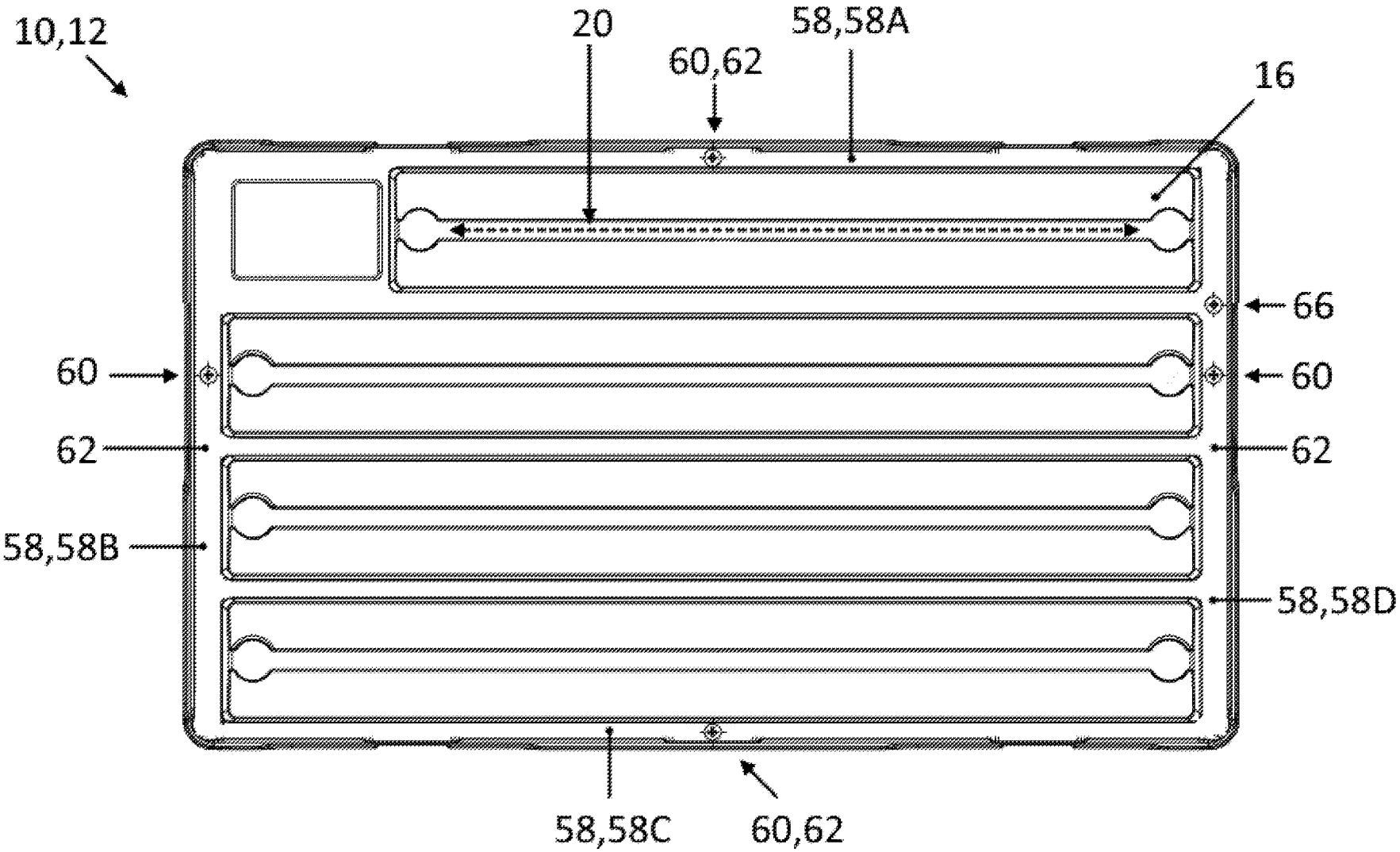
FIG. 10 depicts an embodiment of the core tray having reference markers on an upper surface.

In an embodiment and with reference to FIG. 10, the tray 10 may have a tray length parallel to the longitudinal axes 20 of each of the plurality of slots 16, and a tray width perpendicular thereto. The tray 10 may further comprise a peripheral upper surface 58 that substantially encircles the plurality of slots 16. For the purpose of explanation, the peripheral upper surface 58 may be regarded as being divisible into four peripheral upper surface portions 58A-D consisting of a pair of longitudinally-extending portions 58A, 58C and a pair of laterally-extending portions 58B, 58D. Each of the peripheral upper surface portions 58A-D may comprise a reference marker 60 positioned thereupon, wherein, for each of the peripheral upper surface portions 58A-D, the reference marker 60 is positioned at a distance from a centre 62 of the respective peripheral upper surface portion that is less than or equal to a distance from an end thereof.

Without limiting the scope of the invention through theory, it is anticipated that positioning the reference markers 60 closer to the centre 62 of the respective upper surface portions 58A-D may enable their position and appearance to be more accurately reproduced in a photographic image. Analytical photography of core trays is typically performed with a wide-angled (or "fisheye") lens to capture as much of the tray as possible without requiring significant distance between the tray and the camera, and the distortion profiles typically applied to the resulting images to remove distortion induced by the wide-angle lens is inaccurate in the corners of the image. Therefore, by positioning the reference markers away from the image corners (by positioning them away from the corners of the core tray 10), the distortion applied to the reference markers may be substantially reduced or ameliorated, and the corrective distortion profile applied thereto may be more accurate.

In an embodiment, the distance from the reference marker 60 to the centre 62 of the respective peripheral upper surface portion 58A-D may be one half or less than a distance from the reference marker to the end of the same peripheral upper surface portion. In a further embodiment and for each of the peripheral upper surface portions 58A-D, the distance from the reference marker 60 to the centre 62 of the respective peripheral upper surface portion may be one quarter or less than a distance from the reference marker to the end of the same peripheral upper surface portion. In a further embodiment, the reference marker 60 may be positioned at, or substantially proximal to, the centre 62 of the respective peripheral upper surface portion 58A-D.

In a further embodiment, the tray 10 may comprise a further reference marker 66 positioned at a distance from a centre 62 of the respective peripheral upper surface portion that is less than or equal to a distance from an end thereof.

Figure 11:
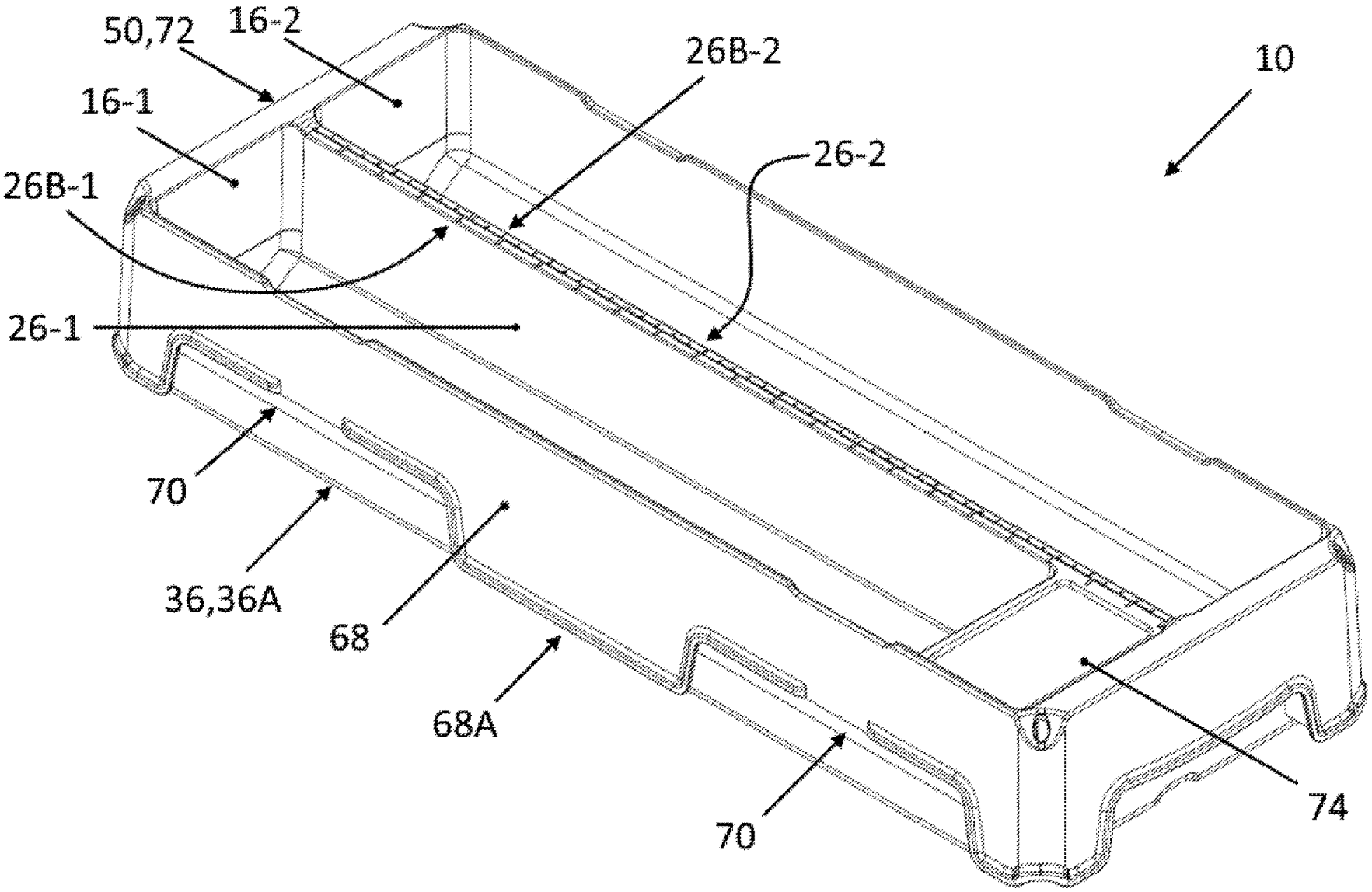
FIG. 11 depicts an embodiment of the core tray having outer walls.

In an embodiment and with reference to FIG. 11, the tray 10 may further comprise outer walls 68 that extend substantially around the periphery, and the outer walls 68 may comprise handles 70 for handling the trays. The handles 70 may be spaced outwardly from a lower surface of the slots 16 so as to provide a clearance for a user' fingers. In a further embodiment wherein the slot base comprises a lower base surface 36, at least a portion of which is adapted to provide a resting surface 36A, the outer walls may be configured such that at least a portion of a lower edge 68A of the outer walls 68 is substantially flush with the resting surface portion 36A of the lower base surface 36, and no portion of the lower edge of the outer walls extends below the resting surface.

In an embodiment and with reference to FIG. 11, the tray 10 may further comprise a substantially planar surface or panel 74 adapted to enable a user of the tray to write thereupon or affix a label thereto.

In an embodiment wherein adjacent side walls 26-1, 26-2 of adjacent slots are joined to one another at an upper end 26B-1, 26B-2 thereof by an upper connective portion 50, a ruler 72 may be formed upon an upper surface thereof. The ruler 72 may be arranged to enable a user to measure a length of a drill core sample within one of the plurality of slots 16.

Figure 12:
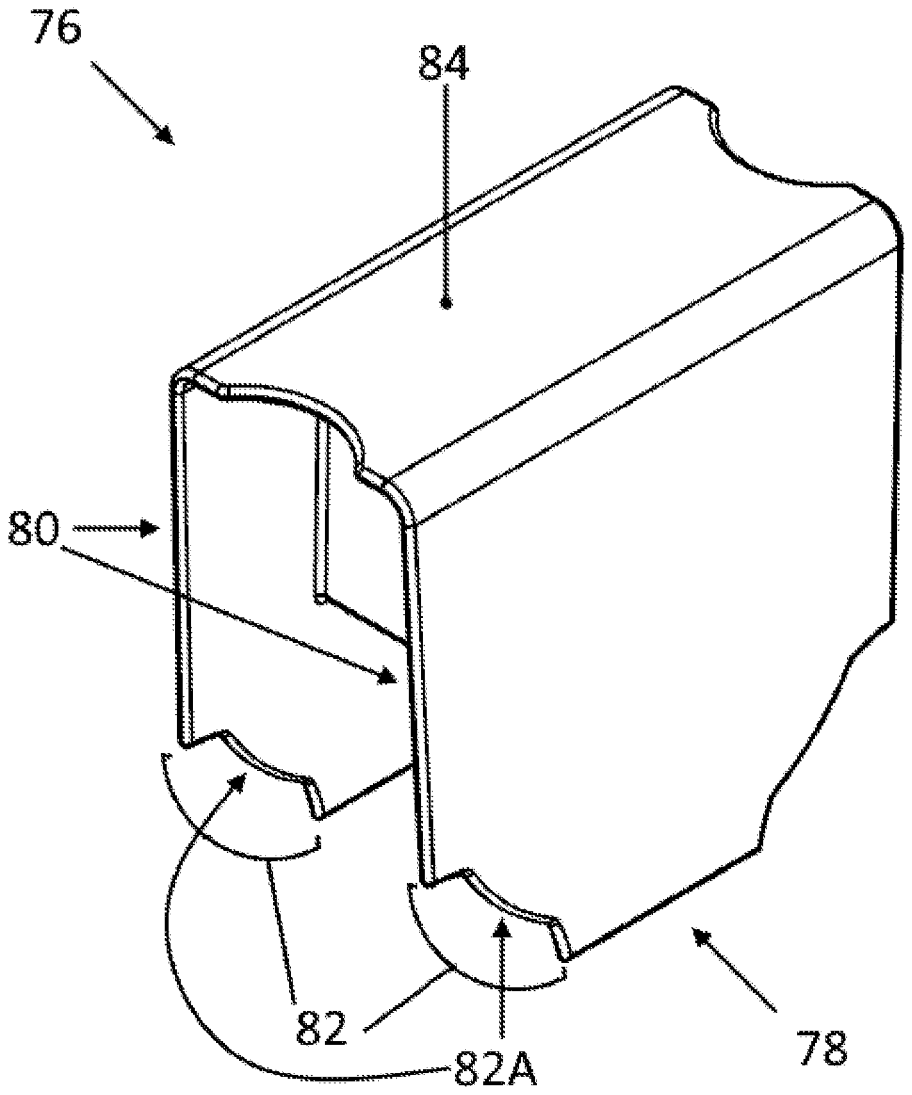
FIG. 12 depicts a slot divider for an embodiment of the core tray.

In an embodiment and with reference to FIG. 12, the tray 10 may further comprise a removable slot divider 76 that is positionable and selectively affixable at a position along the longitudinal axis 20 of any particular slot of the plurality of slots. In a further embodiment, the slot divider 76 may be shaped to be substantially complementary to the substantially-constant cross-section 22 of the particular slot 16. By way of non-limiting example, the slot divider 76 depicted in FIG. 12 comprises a profile that is substantially complementary to the substantially-constant cross-section 22 of a slot 16 and has a base surface complementary region 78, a side wall complementary region 80, and a support portion complementary region 82 with a channel complementary region 82A, however the skilled person will appreciate that the various complementary regions may be adjusted or foregone depending upon the embodiment of the recipient core tray 10. The slot divider 76 may further comprise, on an upper end thereof, a substantially planar surface or panel 84 adapted to enable a user of the tray to write thereupon or affix a label thereto.

While the invention has been described with reference to preferred embodiments above, it will be appreciated by those skilled in the art that it is not limited to those embodiments, but may be embodied in many other forms, variations and modifications other than those specifically described. The invention includes all such variation and modifications. The invention also includes all of the steps, features, components and/or devices referred to or indicated in the specification, individually or collectively and any and all combinations or any two or more of the steps or features.

In this specification, unless the context clearly indicates otherwise, the word "comprising" is not intended to have the exclusive meaning of the word such as "consisting only of", but rather has the non-exclusive meaning, in the sense of "including at least". The same applies, with corresponding grammatical changes, to other forms of the word such as "comprise", etc.

Other definitions for selected terms used herein may be found within the detailed description of the invention and apply throughout. Unless otherwise defined, all other scientific and technical terms used herein have the same meaning as commonly understood to one of ordinary skill in the art to which the invention belongs.

Any promises made in the present document should be understood to relate to some embodiments of the invention, and are not intended to be promises made about the invention in all embodiments. Where there are promises that are deemed to apply to all embodiments of the invention, the applicant/patentee reserves the right to later delete them from the description and they do not rely on these promises for the acceptance or subsequent grant of a patent in any country.

The invention claimed is:

1. A tray for storing geological drill core samples, comprising an upper side and a lower side, and a plurality of slots formed into the upper side, each of the slots having an internal space extending along a longitudinal axis of the respective slot, the internal space adapted to receive at least one of the drill core samples therewithin;

wherein a cross-section of each of the plurality of slots is substantially constant for at least partway along the longitudinal axis of the respective slot;

each of the plurality of slots, when viewed in the substantially-constant cross-section, comprise:

a laterally-extending slot base;

a pair of side walls, one being positioned on either lateral side of the base;

a support portion extending from a lower end of each side wall to a proximal lateral side of the base, each support portion being convexly curved, relative to the internal space of their respective slot, along a length thereof; and an arcuate channel recessed into each support portion, each channel extending for at least a portion of the length of the support portion;

further wherein the support portions and their respective arcuate channels are adapted to receive and support the at least one drill core sample above the slot base and to inhibit said drill core sample from contacting said slot base.

2. The tray of claim 1, wherein, when viewed in the substantially-constant cross-section:

each channel is substantially arcuate in shape, said arc having a constant support channel radius projected from a radial centre; and the channels of a particular slot of the plurality of slots have support channel radii of identical length and their respective radial centres are a common radial centre within the internal space of the particular slot.

3. The tray of claim 2, wherein the particular slot of the plurality of slots is configured to receive a drill core sample of a particular size having a substantially-circular cross section with an associated core sample radius; and the support channel radii of the channels of the particular slot are substantially identical to the core sample radius of the drill core sample of a particular size.

4. The tray of claim 1, wherein, when viewed in the substantially-constant cross-section, the base is concavely curved for at least a portion thereof relative to the internal space of the respective slot.

5. The tray of claim 1, wherein, when viewed in the substantially-constant cross-section, the pair of side walls are angled away from one another such that the lower ends of each of the pair of side walls are closer together than an upper end of each of the pair of side walls.

6. The tray of claim 1, further comprising a ribbing arrangement between a pair of adjacent slots of the plurality of slots;

wherein the ribbing arrangement comprises:

a longitudinally-extending rib arranged to extend parallel to adjacent side walls of the adjacent pair of slots;

a first sequence of ribbing extending at least partially laterally from the longitudinally-extending rib and to a lower side of one of the pair of adjacent slots; and a second sequence of ribbing extending at least partially laterally from the longitudinally-extending rib and to a lower side of the other one of the pair of adjacent slots.

7. The tray of claim 6, wherein:

the slot base comprises a lower base surface, at least a portion of which forms a resting surface of the tray;

at least one lower edge of the ribbing arrangement is substantially flush with the resting surface; and no portion of the ribbing arrangement protrudes past the resting surface.

8. The tray of claim 6, wherein:

a particular slot in the plurality of slots has an adjacent slot on one side thereof and a further adjacent slot on an opposing side thereof;

the particular slot and the adjacent slot are the pair of adjacent slots with the ribbing arrangement therebetween; and the particular slot and the further adjacent slot are a further pair of adjacent slots with a further ribbing arrangement therebetween.

9. The tray of claim 6, wherein at least one of the first and second sequences of ribbing comprise:

a plurality of first ribs that extend substantially perpendicularly to the longitudinally-extending rib; and a plurality of second ribs that extend obliquely to the longitudinally-extending rib and substantially parallel to one another;

each one of the first and second ribs having proximal and distal ends, the proximal ends being proximal to the longitudinally-extending rib and the distal ends being proximal to the lower surface of the slot; and the at least one sequence is formed by alternating first and second ribs.

10. The tray of claim 9, wherein the formed sequence is a sawtooth sequence;

further wherein the proximal end of each first rib in the formed sequence meets the proximal end of the preceding second rib in the formed sequence; and the distal end of each first rib meets the distal end of the succeeding second rib in the formed sequence.

11. The tray of claim 9, wherein:

both the first and second sequences comprise the sequence formed by alternating first and second ribs; and the second sequence is longitudinally staggered with respect to the first sequence, such that the plurality of first ribs of the second sequence do not align with the plurality of first ribs of the first sequence.

12. The tray of claim 9, wherein the plurality of second ribs of the first sequence are substantially non-parallel to the plurality of second ribs of the second sequence.

13. The tray of claim 9, wherein adjacent side walls of the pair of adjacent slots are joined to one another at an upper end thereof by an upper connective portion; and the longitudinally-extending rib extends downwardly from a lower surface thereof.

14. The tray of claim 1, further comprising a ribbing arrangement extending, for at least a portion of a length of the tray, between a pair of adjacent slots of the plurality of slots;

wherein said ribbing arrangement comprises:

a first sequence of ribbing comprising perpendicular ribs that alternately extend from a lower surface of a first one of the pair of adjacent slots and towards a second one thereof, and from a lower surface of the second one of the pair of adjacent slots and towards the first one thereof; and a second sequence of ribbing comprising obliquely-oriented ribs extending between ends of each sequential pair of perpendicular ribs of the first sequence.

15. The tray of claim 14, wherein at least one of the plurality of slots comprises a first adjacent slot on one side and a second adjacent slot on its opposing side;

a first ribbing arrangement extends between the at least one slot and the first adjacent slot, with a portion of the first ribbing sequence thereof extending from a lower surface of the at least one slot towards the first adjacent slot;

a second ribbing arrangement extends between the at least one slot and the second adjacent slot, with a portion of the first ribbing sequence thereof extending from the lower surface of the at least one slot towards the first adjacent slot; and the ribs of the portion of the first ribbing sequence of the first ribbing arrangement are substantially aligned with the ribs of the portion of the first ribbing sequence of the second ribbing arrangement.

16. The tray of claim 14, wherein an angle between each of the perpendicular ribs and their respective obliquely-oriented ribs is between 100° and 150°, inclusive.

17. The tray of claim 1, further comprising outer walls that extend substantially around the periphery; and the outer walls comprise handles that are spaced outwardly from the slots so as to provide a clearance for a user' fingers.

18. The tray according to claim 17, wherein the slot base comprises a lower base surface, at least a portion of which forms a resting surface of the tray;

at least a portion of a lower edge of the outer walls is substantially flush with the resting surface; and no portion of the lower edge of the outer walls extends below the resting surface.

19. The tray of claim 1, further comprising a slot divider that is affixable at a position along the longitudinal axis of a particular slot of the plurality of slots;

wherein the slot divider is shaped to be substantially complementary to the substantially-constant cross-section of the particular slot; and the slot divider further comprises, on an upper end thereof, a substantially planar surface or panel adapted to enable a user of the tray to write thereupon or affix a label thereto.

20. The tray of claim 1, wherein:

the tray has a tray length parallel to the longitudinal axes of each of the plurality of slots and a tray width perpendicular thereto;

the tray further comprises a peripheral upper surface that encircles the plurality of slots, the peripheral upper surface being divisible into four peripheral upper surface portions consisting of a pair of longitudinally-extending portions and a pair of laterally-extending portions;

each of the peripheral upper surface portions comprise one or more reference markers positioned thereupon; and for each of the peripheral upper surface portions, the one or more reference markers are each positioned at a distance from a centre of the respective peripheral upper surface portion that is less than or equal to a distance from an end thereof.

21. The tray of claim 1, further comprising a substantially planar surface or panel adapted to enable a user of the tray to write thereupon or affix a label thereto.

22. The tray of claim 1, wherein adjacent side walls of adjacent slots are joined to one another at an upper end thereof by an upper connective portion; and a ruler is formed upon an upper surface thereof and arranged to enable a user to measure a length of a drill core sample within one of the plurality of slots.

* * * * *